US008826544B1

(12) United States Patent
Savage, Jr.

(10) Patent No.: US 8,826,544 B1
(45) Date of Patent: Sep. 9, 2014

(54) SEALANT REMOVAL TOOL

(76) Inventor: John David Savage, Jr., Springfield, MO (US)

( * ) Notice: Subject to any disclaimer, the term of this patent is extended or adjusted under 35 U.S.C. 154(b) by 220 days.

(21) Appl. No.: 13/353,501

(22) Filed: Jan. 19, 2012

Related U.S. Application Data

(60) Provisional application No. 61/463,096, filed on Feb. 14, 2011.

(51) Int. Cl.
*B26B 7/00* (2006.01)

(52) U.S. Cl.
USPC ..... 30/167; 30/168; 30/357; 30/394

(58) Field of Classification Search
USPC ..... 30/167, 168, 169, 357, 394, 171, 272.1
See application file for complete search history.

(56) References Cited

U.S. PATENT DOCUMENTS

| | | | | |
|---|---|---|---|---|
| 1,627,515 | A | 5/1927 | Laird | |
| 4,080,734 | A | 3/1978 | Barbour | |
| 5,095,573 | A * | 3/1992 | Henke et al. | 15/105 |
| 5,640,772 | A * | 6/1997 | Roeker et al. | 30/169 |
| 5,784,788 | A | 7/1998 | Cothery | |
| 5,924,204 | A * | 7/1999 | Lane | 30/169 |
| 5,953,820 | A * | 9/1999 | Vasudeva | 30/125 |
| 8,314,366 | B2 * | 11/2012 | Evans et al. | 219/229 |
| 2004/0134077 | A1 * | 7/2004 | Martin et al. | 30/167 |
| 2006/0245701 | A1 | 11/2006 | Storaasli et al. | |
| 2007/0062046 | A1 * | 3/2007 | Hsu | 30/167 |
| 2007/0271796 | A1 * | 11/2007 | Oikarinen et al. | 30/169 |

* cited by examiner

*Primary Examiner* — Omar Flores Sanchez
(74) *Attorney, Agent, or Firm* — Richard L. Marsh

(57) ABSTRACT

A tool for removal of sealant from grooves adjacent aircraft inspection panels has a handle and a several different removable cutting tool elements. Each removable cutting tool element has at least one sharply defined cutting edge and several sharply defined cutting points.

13 Claims, 3 Drawing Sheets

SEALANT REMOVAL TOOL

RELATED APPLICATION DATA

This application is a non-provisional application of Applicant's provisional application Ser. No. 61/463,096 filed on 14 Feb. 2011, Applicant claiming the priority date established therein and incorporating the entirety of the disclosure thereof into this application with this reference thereto.

BACKGROUND OF THE INVENTION

1. Field of the Invention

This invention relates to a tool set and tools therefor for removing sealant from joints between structural elements such as aircraft panels and the like.

2. Prior Art Statement

It is known to provide a sealant removal tool adapted for use with a rivet gun. For instance, see the phenolic Scraper for Rivet Gun, model BAT-PHRG-02 sold by Brown Aviation Tool Supply Co., 2536 S.E. 15th Street, Oklahoma City, Okla. 73129. The device is molded from a phenolic resin and thus the cutting edges are not sharply defined. The tool is useful with a rivet gun but some sealant remains on the substrate from which the sealant is removed because of tool chatter caused the high speed intermittent force acting on the tool. These non-durable scrapers are sold in packages of ten, thus requiring frequent tool changes and multiple purchases of tools. Therefore, there exists a great need for a sealant removal tool set with varied tool point design to permit greater and more efficient removal of sealant from joints between structural elements. There is also a need for a sealant removal tool that is formed with precision defined edges from a rigid polymeric substance that is very durable to minimize tool replacement costs and lost time.

It is known to provide a sealant removal tool adapted for use with a rivet gun. For instance, see the No-Mar Rivet Gun Sealant Scraper Model BAT-SCR2PC sold by Brown Aviation Tool Supply Co., 2536 S.E. 15th Street, Oklahoma City, Okla. 73129. The device is molded from a fiber-reinforced composite plastic material and thus the cutting edges are not sharply defined. As with the phenolic scraper described above, tool chatter tends to leave portions of the sealant on the substrate to which the sealant was applied resulting in additional time to remove those portions with solvent and/or cleaning pads. Thus, the need for a sealant removal tool of great durability with highly defined, durable cutting edges is great. There is also a great need for a manual sealant removal tool with interchangeable tool elements for complete removal of sealant from panel grooves on aircraft.

It is also known to provide a rotary sealant removal tool. For instance, see the SOUIX Sealant Removal Kit with SR Cutters, stock number 1AM1151SRK sold by Brown Aviation Tool Supply Co., 2536 S.E. 15th Street, Oklahoma City, Okla. 73129. The threaded drill motor operates at 800 rpm and the SR cutters are formed from a heavy duty plastic material and have multiple external cutting edges. Though there are two diameters of cutters, the number of cutting edges is constant. At 800 rpm with four cutting edges, each cutting edge endures 800 impacts per minute and thus the speed of cutting quickly erodes the cutting edges resulting in multiple tool replacements. Tool chatter is prevalent with the rotary cutter, especially along panel seams. Thus, the need for a manually operated sealant removal tool set of great durability and varied tool point design permit greater and more efficient removal of sealant from joints between structural elements is great. There is also a need for a sealant removal tool that is machined from polyacrylate to provide the durability necessary for sealant removal without causing damage to the surrounding metal.

It is likewise known to provide a "Y" Head Heavy Duty Sealant Scraper, item code BAT-ATH7 formed from a plastic resin having an ergonomic handle design with finger cutouts for operator comfort. This manual scraper is offered for sale in quantities of 10 by Brown Aviation Tool Supply Co., 2536 S.E. 15th Street, Oklahoma City, Okla. 73129. The tool does not have sharply defined cutting edges and the inventor hereof has found that the tool is somewhat flexible and is not durable for longtime use in sealant removal. Tool replacement is often and though the tools are relatively inexpensive the total cost for any job is high. Accordingly, the need for a manual sealant removal tool having removable elements with multiple configurations is great. Additionally, the need for a durable sealant removal cutting edge is significant.

It is well known to provide a sealant removal tool to access a groove cable in a street lane by removing the fill material in the groove where the cable is laid. For instance, see the U. S. Patent Application 20060245701 A1, published on 2 Nov. 2006 by Storaasli, et al. The sealant removal tool is a steel plow of approximately the width of the groove in the concrete. The tool is used with great force and often contacts the concrete with the cutting edges though damage to the concrete not critical as in aircraft panel removal. Hence, there is a great need for a manual sealant removal tool that cannot not damage the material surrounding the sealant being removed. Furthermore, there is a great need for a manual sealant removal tool having multiple cutting elements of different configuration for the multiple sealant removal tasks on an aircraft.

Another prior art device known cutting tool for piercing and removing an urethane sealant around an automotive windshield. The tool is provided with a handle on an elongated stem which is pivotally secured to a blade receiving body. The body has quick release means for the commonly metal tool blade. For instance, see the U.S. Pat. No. 5,784,788 issued on 28 Jul. 1998 to Jeffrey R. Cothery. As the blade is a metal blade, scoring of the aircraft skin would result. Furthermore, the aircraft inspection panel edges are screwed to the aircraft skin and therefore there is no room to place the 90 degree cutting blade of this invention. Therefore, the great need for a manual sealant removal tool having a plurality of replaceable polymeric cutting elements that will completely remove sealant from an aircraft panel groove without marring the surface of the aircraft skin is still present.

Additionally, it is known to provide percussion tool for removal of a windshield from a vehicle. The percussion tool comprises a shank having a trapezoidal wing shaped tool steel blade seam welded to one end of the shank wherein the opposed end of the shank is driven by a pneumatic implement tool. For instance, see the U.S. Pat. No. 4,080,734, issued on 28 Mar. 1978 by Deryle R. Barbour. Since the blade is permanently fixed to shank the tool must be discarded when the blade is beyond use. Furthermore, the device is driven with pneumatic hammer which is difficult to control in a narrow groove such as an aircraft inspection panel groove and since the nose of the shank extends beyond the blade, damage to the aircraft skin will result. Thus, there is still a significant need for manual sealant removal tool that comprises a handle and a plurality of replaceable cutting tool elements wherein the cutting tool elements have at least one cutting edge and a plurality of cutting points.

Finally, it is known to provide reefing tool for removing pitch, marine glue, oakum, cotton and other packing material from the seams of decks, bottoms and sides of a wooden marine vessel. The tool comprises a shank with a metal blade extending beyond an angled end of the shank. The shank has an enlarged head end adapted to be hammered with a mallet. A second person guides the tool and controls the depth with a handle removably associated with the shank. For instance, see the U.S. Pat. No. 1,627,515 issued on 3 May 1927 by C. L. Laird. As with the tool to Barbour, contact of the metal tool and/or handle nose with the aircraft skin will cause damage and thus the need for a manual sealant removal tool that comprises a handle and a plurality of replaceable polymeric cutting tool elements having at least one cutting edge and a plurality of cutting points is still great.

SUMMARY OF THE INVENTION

A primary object of this invention is to provide a tool to efficiently remove sealant from aircraft inspection panels to remove the panel for inspection without using metal putty knives or other metal objects.

One object of this invention is to provide a tool for removal of sealant from grooves adjacent aircraft inspection panels, the tool comprising a handle and a plurality of removable cutting tool elements wherein each removable cutting tool element is provided with at least one sharply defined cutting edge and a plurality of sharply defined cutting points.

A primary goal of this invention is to provide sealant removal tool screwdriver grip and a threaded shank end to attach different style tips to give flexibility to clean grooves where sealant is imbedded or where differing amounts of sealant or narrow groove widths exist.

A significant feature of this invention is to provide a tool for efficient removal of sealant from grooves adjacent aircraft inspection panels comprises a handle and a plurality of removable polymeric cutting tool elements wherein the handle further comprising a hand grip and an elongated shank protruding from one end of the hand grip, the elongated shank provided with a means for connecting on a free end thereof and wherein the removable cutting tool elements are provided with at least one sharply defined cutting edge and a plurality of sharply defined cutting points.

A main purpose of this invention is to provide sharply defined cutting edge bound between a bottom surface and a top surface of a cutting tool element for removal of sealant from grooves adjacent aircraft inspection panels wherein the sharply defined cutting edge is disposed at a bottom edge of a sloped chisel surface on a distal end of the tool element and wherein the ends of the sharply defined cutting edge at the bottom edge of the sloped surface terminates in two sharply defined cutting points.

A primary principle of this invention is to provide a tool for removal of sealant from grooves adjacent aircraft inspection panels that comprises a handle and a plurality of removable polymeric cutting tool elements that are in an arrowhead shape and are provided with two sharply defined cutting edges and a plurality of sharply defined cutting points.

A principal aim of this invention is to provide a tool for efficient and effective removal of sealant from grooves with polymeric cutting tool elements with sharply defined cutting edges disposed on opposed, adjacent side edges of an arrowhead shape and equally arranged relative to a central axis of the cutting tool element.

A primary aspect of this invention is to provide a tool for removal of sealant from grooves with polymeric cutting tool elements having varied tool point designs to permit greater and more efficient removal of sealant wherein one cutting tool element is provided with sharply defined cutting edges disposed on opposed, adjacent side edges of an arrowhead shape wherein the sharply defined cutting edges have an angle between 20 and 60 degrees relative to a central axis of the cutting tool element.

A significant object of this invention is to provide one method of making a tool for removal of sealant from grooves adjacent aircraft inspection panels wherein the tool comprises a handle and a plurality of removable, interchangeable cutting tool elements formed with precision defined edges from a rigid polymeric substance.

DESCRIPTION OF THE PREFERRED EMBODIMENTS

When an aircraft panel is installed on the aircraft, screws are inserted into holes around the perimeter of the panel and driven into framework under the panel to hold the panel in place. Then masking tape is applied to the edge of the panel right at the groove where sealant will be squeezed into and also at the outer groove edge on the outer skin edge on the aircraft to keep the sealant off aircraft. This keeps the sealant isolated to just the groove and not on the panel or the aircraft. After applying sealant to the groove, the sealant is back troweled along the masking tape to make the sealant flush with the panel and the aircraft. The masking tape is then removed from the panel and the aircraft before the sealant cures. After curing, the sealant becomes like hard rubber. There is no real feasible way to remove the sealant though the practice of removing sealant using metal putty knives or a metal object like a knife is widely used but that practice is prohibited as it will damage the aluminum skin of the aircraft.

Figure 1:
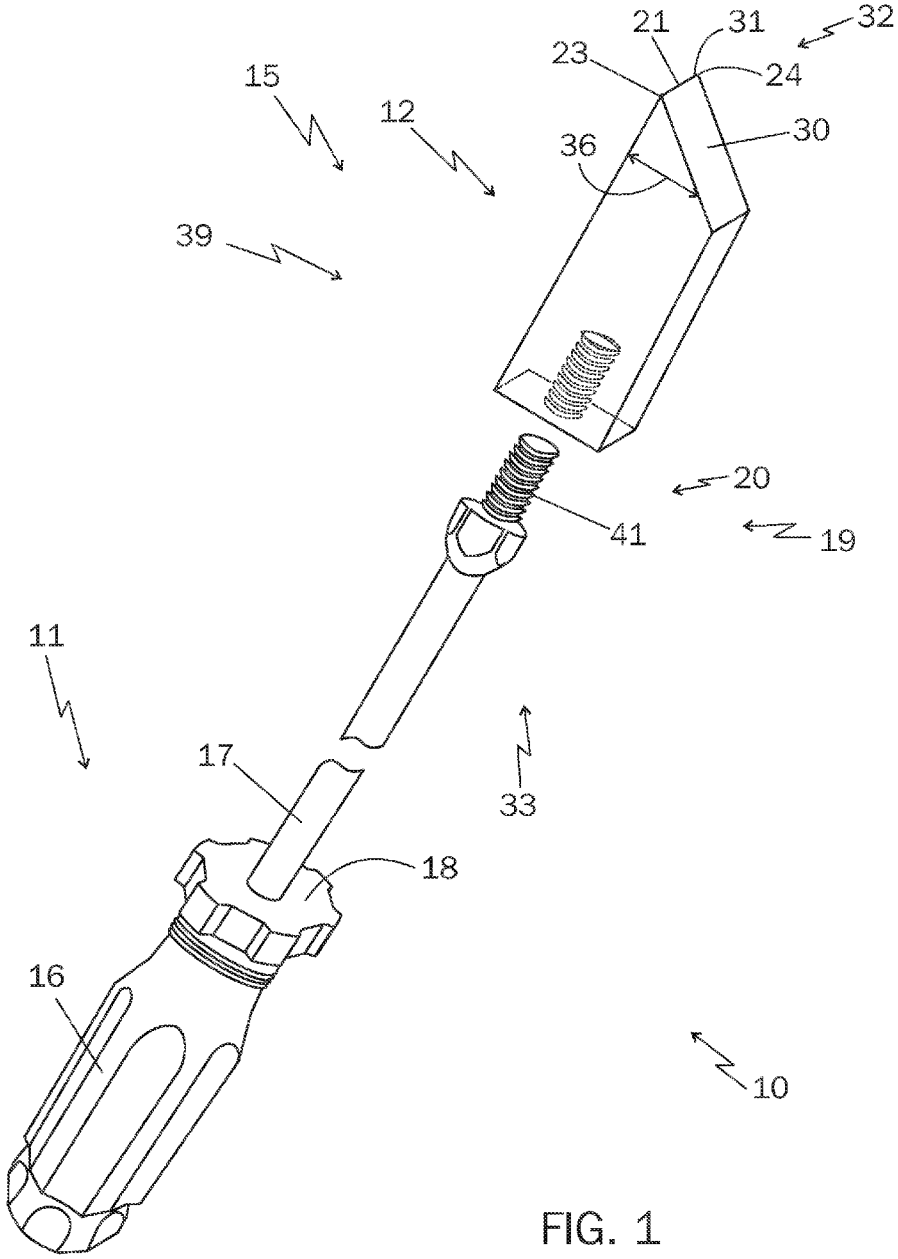
FIG. 1 is a perspective view of the sealant removal tool of this invention showing the wide chisel point cutting tool elements.

Referring now to FIG. 1, a tool for removal of sealant from grooves adjacent aircraft inspection panels is generally shown by the numeral 10. Sealant removal tool 10 comprises a handle 11 and a plurality of removable polymeric cutting tool elements 12-14, 56, cutting tool element 12 shown attached to a free end 15 of handle 11 and cutting tool elements 13, 14, 56 shown in FIGS. 2-5 respectively. Handle 11 further comprises a hand grip 16 and an elongated shank 17 protruding from one end 18 of hand grip 16, elongated shank 17 provided with a means 19 for connecting on a free end 20 thereof. Removable cutting tool elements 12-14, 56 are provided with at least one sharply defined cutting edge 21, 22, a plurality of sharply defined cutting points 23, 24 & 28, 38 and cooperating means 34 for connection.

Figure 2:
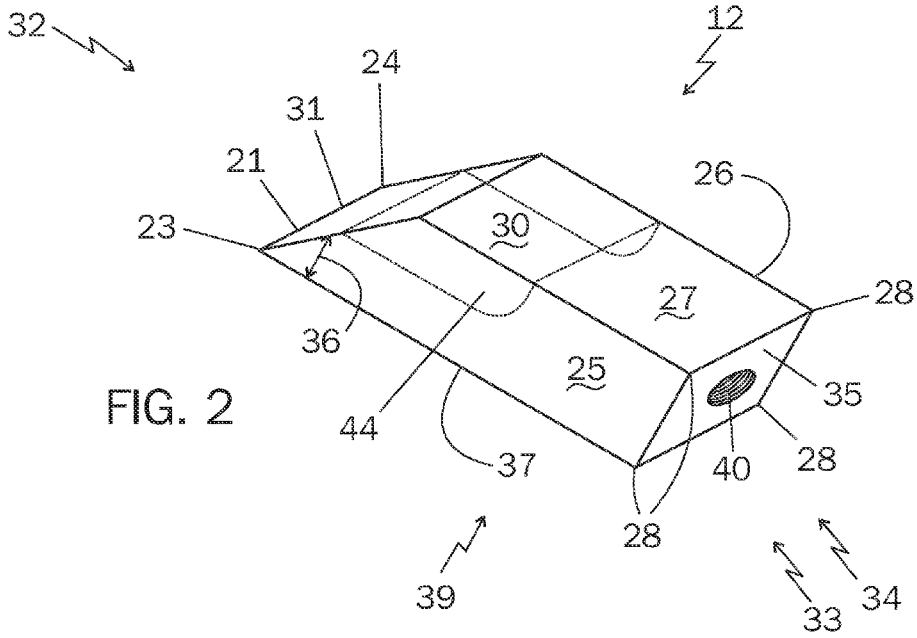
FIG. 2 is an enlarged perspective view of the wide chisel point cutting tool elements for the sealant removal tool of FIG. 1.

Referring specifically to FIG. 2, cutting tool element 12 for sealant removal tool 10 has sharply defined cutting edge 21 thereof disposed at a bottom end 31 of a sloped chisel surface 30 on a distal end 32 of cutting tool element 12, bottom end 31 terminating at sidewalls 25, 26 in two sharply defined cutting points 23-24. Sloped chisel surface 30 is defined between a bottom surface 37 and a top surface 27 of cutting tool element 12 and between sidewalls 25, 26. Sharply defined cutting points 23, 24 are defined at sidewalls 25, 26 of sharply defined cutting edge 21 at bottom end 31 of cutting tool element 12. Sloped chisel surface 30 is disposed at an angle 36 between 25 and 65 degrees relative to the bottom surface 37 and is most preferably disposed at angle 36 of 45 degrees. Sharply defined cutting edge 21 of sloped chisel surface 30 preferably has a width between one half inch and one and one half inch. Multiple cutting tool elements 12 of differing widths are thus provided usually in increments of one quarter inch though it is fully within the scope of this invention to provide for a width of sharply defined cutting edge 21 greater than one and one half inch. A width of less than one half inch for sharply defined cutting edge 21 is easily accomplished by cutting tool element 13 of FIG. 3 as described below. Though sloped chisel surface 30 is shown extending from bottom surface 37 to top surface 27 it is within the scope of this invention to provide a relief 44 into, and part way up sloped chisel surface 30 to provide for greater view of sharply defined cutting edge 21 and/or sharply defined cutting points 23, 24.

In operation, cutting tool element 12 is removably affixed to free end 20 of elongated shank 17, hand grip 16 of handle 11 grasped by one hand by the operator thereof, sharply defined cutting edge 21 engaged with a surface of an aircraft skin at a groove between the aircraft skin and an adjacent panel with one sharply defined cutting point 23, 24 engaged against the edge of the panel in the groove whereafter the operator of sealant removal tool 10 pushes sealant removal tool 10 along the groove thereby cutting away substantially all of the sealant previously applied to the groove. As sealant removal tool 10 is provided with sharply defined cutting edge 21 and sharply defined cutting points 23, 24 on cutting tool element 12, removal of substantially all of the sealant in the groove is accomplished in a single operation thus achieving at least one object of this invention, specifically efficient removal of substantially all of the sealant using manual sealant removal tool 10.

Still referring specifically to FIG. 2, cutting tool element 12 has a base section 39 extending aft of sloped chisel surface 30, base section 39 terminating at a back wall 35 at the proximal end 33 of cutting tool element 12. Base section 39 may be provided with additional sharply defined cutting points 28 disposed at corners of back wall 35 of proximal end 33 wherein sharply defined cutting points 28 are bound between sidewalls 25, 26, top surface 27 and bottom surface 37. Sharply defined cutting points 28 are best used where the angle of attack may require drawing sealant removal tool 10 towards the operator thereof in order to remove sealant from the groove. The primary purpose of base section 39 though is to provide for cooperating means 34 for connecting, cooperating means 34 preferably disposed into proximal end 33 of base section 39 through back wall 35. Cooperating means 34 is preferably a threaded hole 40 disposed into back wall 35 wherein cooperating means 34 is adapted to engage means 19 for connecting which is preferably a threaded portion 41 of free end 20 of elongated shank 17. Though means 19 for connecting and cooperating means 34 are preferably threaded connections, it is fully within the scope of this invention to provide for means 19 for connecting and cooperating means 34 selected from the group comprising threads, quick disconnects, quarter-turn key lock, button lock, spring pin or combinations thereof. Cooperating means 34 is preferably disposed into proximal end 33 normal to back wall 35, however, it should be fully understood that cooperating means 34 may be disposed into proximal end 33 at an angle to back wall 35. It should also be fully understood that cooperating means 34 may protrude from proximal end 33 of base section 39 while means 19 for connecting may be disposed into a receiver at free end 20 of elongated shank 17 without departing from the scope of this invention. As free end 20 of elongated shank 17 is provided with means 19 for connecting and cutting tool elements 12-14, 56 are each provided with means 34 for connecting, cutting tool elements 12-14, 56 may be quickly removed from free end 20 of elongated shank 17 and replaced with another cutting tool element 12-14, 56 to perform further sealant removal thus achieving another object of the invention, most specifically that of interchangeability.

Figure 3:
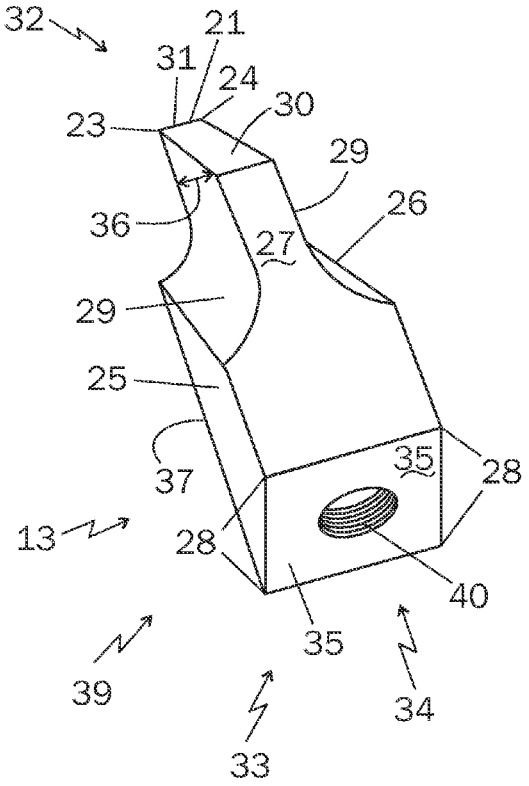
FIG. 3 is an enlarged perspective view of the narrow chisel point cutting tool elements for the sealant removal tool of FIG. 1.

Referring now specifically to FIG. 3, cutting tool element 13 of sealant removal tool 10 has sharply defined cutting edge 21 of cutting tool element 13 disposed at a bottom end 31 of a sloped chisel surface 30 on a distal end 32 of tool element 13, bottom end 31 terminating between indented sidewalls 29 in sharply defined cutting points 23-24. Sloped chisel surface 30 is defined between a bottom surface 37 and a top surface 27 of cutting tool element 13 and between indented sidewalls 29. Sharply defined cutting points 23, 24 are thus bound by bottom surface 37 and indented sidewalls 29 of sloped chisel surface 30, sloped chisel surface 30 having at least one indented sidewall 29 thereof disposed inwardly of one of sidewalls 25, 26 of cutting tool element 13. Though sharply defined cutting edge 21 is shown as centrally disposed on distal end 32 of sloped chisel surface 30 wherein sloped chisel surface 30 is defined between two indented sidewalls 29, it should be fully understood that sharply defined cutting edge 21 may be defined between sidewall 25 and indented sidewall 29 or between sidewall 26 and indented sidewall 29. It should also be fully understood that either or both indented sidewalls 29 may be unequally disposed relative to sidewalls 25, 26. As with sloped chisel surface 30 of cutting tool element 12 of FIG. 2, sloped chisel surface 30 of cutting tool element 13 is also disposed at an angle 36 between 25 and 65 degrees relative to bottom surface 37 and is most preferably disposed at angle 36 of 45 degrees. Sharply defined cutting edge 21 of sloped chisel surface 30 of cutting tool element 13 preferably has a width between one-sixteenth of an inch and one half inch and thus multiple cutting tool elements 13 of differing widths preferably at one-sixteenth inch increments may be produced for a set of cutting tool elements 12-14, 56 for sealant removal tool 10.

Still referring specifically to FIG. 3, cutting tool element 13 also has a base section 39 extending aft of sloped chisel surface 30, base section 39 terminating at a back wall 35 at the proximal end 33 of cutting tool element 13. As with cutting tool element 12, base section 39 may be provided with additional sharply defined cutting points 28 disposed at corners of back wall 35 of proximal end 33 wherein sharply defined cutting points 28 are bound between sidewalls 25, 26, top surface 27 and bottom surface 37. Base section 39 of cutting tool element 13 is also provided with cooperating means 34 for connecting, cooperating means 34 preferably centrally disposed into proximal end 33 of base section 39 through back wall 35. Cooperating means 34 is preferably a threaded hole 40 disposed into back wall 35 wherein cooperating means 34 is adapted to engage means 19 for connecting which is preferably a threaded end 41 of free end 20 of elongated shank 17. Though means 19 for connecting and cooperating means 34 are preferably threaded connections, it is fully within the scope of this invention to provide for means 19 for connecting and cooperating means 34 selected from the group comprising threads, quick disconnects, quarter-turn key lock, button lock, spring pin or combinations thereof. Operation of cutting tool element 13 is substantially identical to the operation of cutting tool element 12 once cutting tool element 13 has been connected to free end 20 of elongated shank 17 however, it should be understood that cutting tool element 13 is best used where a width of sealant disposed onto an aircraft skin is minimal thus achieving another object of the invention, interchangeability of cutting tool elements 12-14 and 56 for differing amounts of sealant or narrow groove widths.

Figure 4:
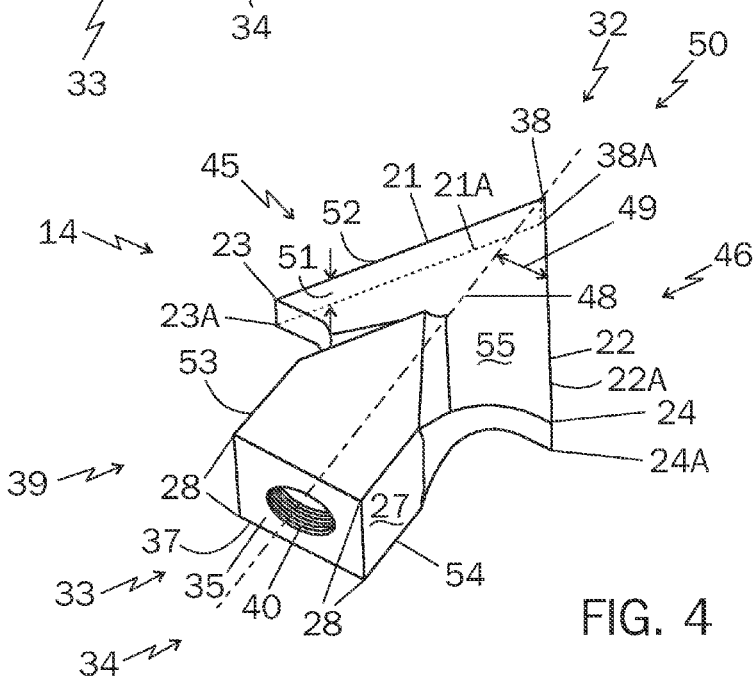
FIG. 4 is an enlarged perspective view of the arrowhead point cutting tool elements for the sealant removal tool of FIG. 1.

Cutting tool element 14 for sealant removal tool 10, shown best in FIG. 4, is a generally arrowhead 47 and provided with two sharply defined cutting edges 21, 22 and a plurality of sharply defined cutting points 23, 23*a*, 24, 24*a*, 38 and 38*a* wherein sharply defined cutting edges 21, 21*a*, 22 and 22*a* are disposed on opposed, end joined sides 45, 46 of arrowhead 47, end joined sides 45, 46 equally arranged relative to a central axis 48 of cutting tool element 14. End joined sides 45, 46 are disposed at an angle 49 of between 20 and 60 degrees relative to central axis 48 and most preferably, angle 49 is 30 or 35 degrees. Sharply defined cutting edges 21, 22 extend from sharply defined cutting point 38 at a terminal point 50 of distal end 32 of arrowhead 47, sharply defined cutting edges 21, 22 terminating in sharply defined back end arrowhead points 23, 24 respectively. As end joined sides 45, 46 have a thickness 51, sharply defined cutting edges 21, 22 have parallel sharply defined cutting edges 21*a* and 22*a* extending from sharply defined cutting point 38*a* at terminal point 50 of arrowhead 47 to sharply defined back end arrowhead points 23*a*, 24*a* respectively. Thickness 51 is preferably from about one sixteenth of an inch to about one quarter inch though thickness 51 may be greater or lesser without departing from the scope of this invention. Cutting tool element 14 also has base section 39 extending rearwardly from arrowhead 47, base section 39 rectangular in cross sectional area and provided with cooperating means 34 associated with back wall 35 of proximal end 33, cooperating means 34 adapted to mate with means 19 for connecting of handle 11. Preferably arrowhead 47 is centrally disposed upon base section 39 however, it is fully within the scope of this invention to off set arrowhead 47 relative to central axis 48 and/or to rotate arrowhead 47 at an angle relative to base section 39. As provided for cutting tool elements 12, 13, 56, cooperating means 34 is preferably a threaded connection, however, it is fully within the scope of this invention to provide for means 19 for connecting and cooperating means 34 selected from the group comprising threads, quick disconnects, quarter-turn key lock, button lock, spring pin or combinations thereof.

Figure 5:
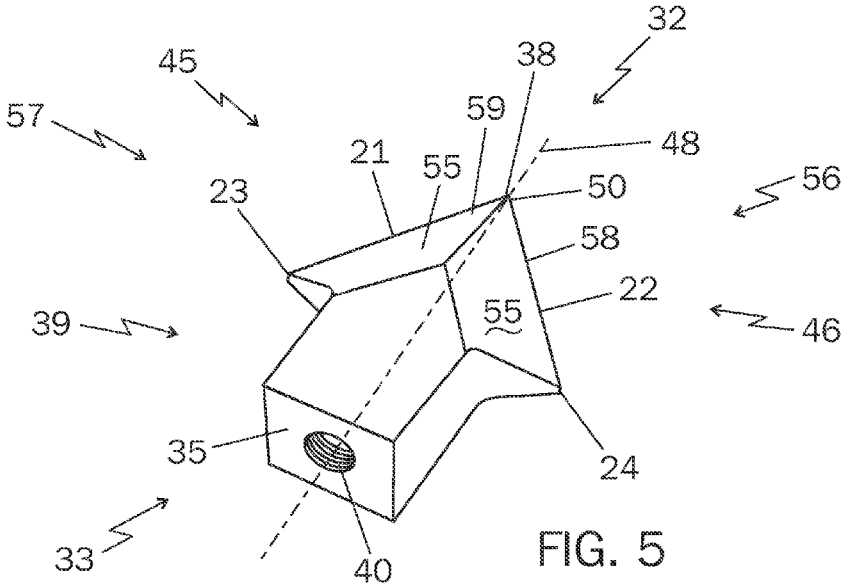
FIG. 5 is an enlarged perspective view of the plow shaped point cutting tool element for the sealant removal tool of FIG. 1.

Cutting tool element 14 for sealant removal tool 10 may be formed as a plow shape 57 best shown in FIG. 5, thus establishing yet another varied design cutting tool element 56. Cutting tool element 56 is provided with two sharply defined cutting edges 21, 22 and a plurality of sharply defined cutting points 23, 24 and 38 wherein sharply defined cutting edges 21 and 22 are disposed on opposed, end joined sides 45, 46 of plow shape 57, end joined sides 45, 46 equally arranged relative to a central axis 48 of cutting tool element 56. End joined sides 45, 46 are disposed at an angle 49 of between 20 and 60 degrees relative to central axis 48 and most preferably, angle 49 is 30 or 35 degrees. Sharply defined cutting edges 21, 22 extend from sharply defined cutting point 38 at a terminal point 50 of distal end 32 of arrowhead 47, sharply defined cutting edges 21, 22 terminating in sharply defined back end arrowhead points 23, 24 respectively. End joined sides 45, 46 have tapered plow edges 58, 59 thus defining sharply defined cutting edges 21, 22 sharply defined cutting edges 21*a* and 22*a* extending from sharply defined cutting point 38*a* at terminal point 50 of arrowhead 47 to sharply defined back end arrowhead points 23, 24. Cutting tool element 56 also has base section 39 extending rearwardly from plow shape 57, base section 39 preferably rectangular in cross sectional area and provided with cooperating means 34 associated with back wall 35 of proximal end 33, cooperating means 34 adapted to mate with means 19 for connecting of handle 11. Preferably plow shape 57 is centrally disposed upon base section 39 however, it is fully within the scope of this invention to offset plow shape 57 relative to central axis 48 and/or to rotate plow shape 57 at an angle relative to base section 39. As provided for cutting tool elements 12-14 cooperating means 34 is preferably a threaded connection, however, it is fully within the scope of this invention to provide for means 19 for connecting 19 and cooperating means 34 selected from the group comprising threads, quick disconnects, quarter-turn key lock, button lock, spring pin or combinations thereof.

Connected to free end 20 of elongated shank 17, operation of cutting tool element 14 requires that sharply defined cutting point 38 or 38*a* be inserted into the groove between the inspection panel and the aircraft skin with sharply defined cutting edge 21, 21*a*, 22 or 22*a* laid adjacent the edge of the inspection panel or the surface of the aircraft skin Cutting tool 14 is then pushed along the groove between the panel and the aircraft skin thus gently but effectively completely removing the sealant from the groove. Where the angle of attack requires that cutting tool element 14 be drawn toward the operator, one of sharply defined cutting points 23, 23*a*, 24, 24*a* is placed in the groove between the aircraft inspection panel and the skin of the aircraft while the associated sharply defined cutting edge 21, 21*a*, 22, 22*a* may be laid against the edge of the inspection panel or the surface of the aircraft skin Thus, in drawing cutting tool element 14 toward the operator, sealant in the groove is again effectively removed from the groove. Cutting tool element 14 provides for different angles of attack relative to the groove and the inspection panel thus providing yet another degree of flexibility and achieving that goal of this invention.

A method of making cutting tool element 12 for sealant removal tool 10 wherein cutting tool element 12 has sharply defined cutting edge 21 thereof greater than one half inch in width for sealant removal tool 10 comprises cutting at least one rectangular block approximately two inches in length for from a thick sheet of rigid polymeric material selected from the group consisting of acetals, vinyls, tetrafluoroethylenes, propylenes, ethylenes, styrenes, amides, amide-imides, parabenzamides, vinylchlorides, carbonates, ABS, acrylates and/or filled compositions or combinations thereof, most preferably from a polyacrylate known as LEXAN® 9034. Most preferably cutting tool element 12 having sharply defined cutting edge 21 greater than one-half inch is cut from a sheet one half inch in thickness wherein the block is cut to a width at least equal, and preferably accurately cut exactly to the desired width of sharply defined cutting edge 21. A second step in the method of making comprises cutting a distal end 32 of the rectangular block at angle 36 from a top surface 27 of the block to a bottom surface 37 thereof wherein top surface 27 and bottom surface 37 are defined by the flat sides of the original thick sheet of rigid polymeric material. Angle 36 is between 25 and 65 degrees relative to bottom surface 37 and is most preferably cut at 45 degrees thus producing sharply defined cutting edge 21 adjacent bottom surface 37 thus establishing bottom end 31 of sloped chisel surface 30 at distal end 32. A further step of machining sidewalls 25, 26 of the rectangular block may be necessary thus defining two sharply defined cutting points 23, 24 at opposed ends of sharply defined cutting edge 21 though accurate cutting from the sheet of material effectively eliminates this step. A step of cutting proximal end 33 of the rectangular block square with the sidewalls 25, 26 thus producing four sharply defined cutting points 28 at the proximal end 33 of the rectangular block may be necessary, however accurate cutting from the original sheet may eliminate this step. A step of providing cooperating means 34 on proximal end 33 comprises drilling and tapping threaded hole 40 into back wall 35 of proximal end 33 thus completing cutting tool element 12.

A method of making cutting tool element 12 for sealant removal tool 10 wherein cutting tool element 12 has sharply defined cutting edge 21 of a width of one-half inch comprises a first step of cutting at least one rectangular block approximately two inches in length for cutting tool element 12 from a thick sheet of rigid polymeric material, preferably from a polyacrylate known as LEXAN® 9034 and most preferably from a sheet one half inch in thickness wherein top surface 27 and bottom surface 37 are defined by the cut sides from the thick sheet of rigid polymeric material and wherein the original calendered surfaces of the original sheet establish sidewalls 25, 26. A second step in the method of making cutting tool element 12 comprises cutting a distal end 32 of the rectangular block at angle 36 from a top surface 27 of the block to a bottom surface 37 thereof. Angle 36 is between 25 and 65 degrees relative to bottom surface 37 and is most preferably cut at 45 degrees thus producing sharply defined cutting edge 21 adjacent bottom surface 37 thus establishing bottom end 31 of sloped chisel surface 30 at distal end 32. A further step of machining bottom surface 37 of the rectangular block may be necessary thus defining two sharply defined cutting points 23, 24 at opposed ends of sharply defined cutting edge 21 though accurate cutting from the sheet of material effectively eliminates this step. A step of cutting proximal end 33 of the rectangular block square with the sidewalls 25, 26 thus producing four sharply defined cutting points 28 at proximal end 33 of the rectangular block may be necessary, however, again accurate cutting from the original sheet may eliminate this step. A step of providing cooperating means 34 on proximal end 33 comprises drilling and tapping threaded hole 40 into back wall 35 of proximal end 33 thus completing cutting tool element 12 of a width of one half inch.

A method of making cutting tool element 13 for sealant removal tool 10 wherein cutting tool element 13 has sharply defined cutting edge 21 of a width of less than one-half inch comprises a first step of cutting at least one rectangular block approximately two inches in length for cutting tool element 13 from a thick sheet of rigid polymeric material, preferably a polyacrylate known as LEXAN® 9034 and most preferably from a sheet one half inch in thickness wherein top surface 27 and bottom surface 37 are defined by the cut sides from the thick sheet of rigid polymeric material and wherein the original calendered surfaces of the original sheet establish sidewalls 25, 26. A second step in the method of making cutting tool element 13 comprises cutting a distal end 32 of the rectangular block at angle 36 from a top surface 27 of the block to a bottom surface 37 thereof. Angle 36 is between 25 and 65 degrees relative to bottom surface 37 and is most preferably cut at 45 degrees thus producing sharply defined cutting edge 21 adjacent bottom surface 37 thus establishing bottom end 31 of sloped chisel surface 30 at distal end 32. A step of establishing at least one indented sidewall 29 inwardly from one or both of sidewalls 25, 26 comprises machining a cut at an angle equal to angle 36 from top surface 27 to bottom surface 37 approximately one-half inch from proximal end 33. The step of machining the cut of a fixed width is to partially or completely establish a width of defined sharply cutting edge 21 depending upon whether sharply defined cutting edge 21 is offset relative to one or both sidewalls 25, 26. A further step of machining bottom surface 37 of the rectangular block may be necessary thus defining two sharply defined cutting points 23, 24 at opposed ends of sharply defined cutting edge 21 though accurate cutting from the sheet of material effectively eliminates this step. A step of cutting proximal end 33 of the rectangular block square with the sidewalls 25, 26 thus producing four sharply defined cutting points 28 at proximal end 33 of the rectangular block may be necessary, however, again accurate cutting from the original sheet may eliminate this step. A step of providing cooperating means 34 on proximal end 33 comprises drilling and tapping threaded hole 40 into back wall 35 of proximal end 33 thus completing cutting tool element 13 of a width of less than one half inch.

A method of making cutting tool element 14 for sealant removal tool 10 wherein cutting tool element 14 is formed with precision defined edges from a rigid polymeric substance, cutting tool element 14 provided with a plurality of sharply defined cutting edges 21, 21*a*, 22, 22*a* comprises a first step of cutting at least one rectangular block approximately two inches in length and approximately one and one-half inches wide for cutting tool element 14 from a one half inch thick sheet of rigid polymeric material, preferably a polyacrylate known as LEXAN® 9034 wherein top surface 27 and bottom surface 37 are defined by the calendered sides of the thick sheet of rigid polymeric material and wherein the cut sides of the original sheet establish sidewalls 25, 26. A second step in the method of making cutting tool element 14 comprises cutting a distal end 32 of the rectangular block from sidewall 25 and from sidewall 26 of the block in an arrowhead 47 at an angle 49. Angle 49 is between 20 and 60 degrees relative to central axis of cutting tool element 14 and most preferably is cut at 30-35 degrees thus producing end joined sides 45, 46 and terminal point 50. Angle 49 may be varied depending upon the final thickness sharply defined cutting edges 21, 21*a*, 22, 22*a*. A step of establishing an indented top surface 55 inwardly from initial top surface 27 and/or an indented bottom surface 52 from initial bottom surface 37 establishes thickness 51 of arrowhead 47 and further establishes sharply defined cutting points 23, 23*a*, 24, 24*a*, 38 and 38*a*. It should be understood here that the step of cutting indented top surface 55 and/or indented bottom surface 52 will also locate arrowhead 47 with respect to top surface 27 and/or indented bottom surface 52 and that arrowhead 47 may be offset relative to central axis 48. The step of cutting one or both of initial sidewalls 25, 26 comprises machining a cut inwardly from sidewall 25, 26 to expose for use sharply defined cutting points 23, 23*a*, 24 and 24*a* establishes new sidewalls 53, 54 of base section 39. Base section 39 may be effectively square in cross section however, it is within the scope of this invention to form base section 39 in other configurations. A step of cutting proximal end 33 of the rectangular block square with new sidewalls 53, 54 thus producing four sharply defined cutting points 28 at proximal end 33 of the rectangular block may be necessary, however, again accurate cutting from the original sheet may eliminate this step. A step of providing cooperating means 34 associated with proximal end 33 preferably comprises drilling and tapping threaded hole 40 into back wall 35 of proximal end 33 thus completing cutting tool element 14 having base section 39 in rectangular cross sectional shape with arrowhead 47 projecting forward of base section 39 in thickness 51 defined between indented top surface 55 and indented bottom surface 52.

A method of making cutting tool element 56 is similar to the method of making cutting tool element 14, however, bottom surface 37 is retained when the block is cut from a one half inch thick sheet of rigid polymeric material, preferably a polyacrylate known as LEXAN® 9034. Indented top surface 55 is cut at an angle relative to top surface 27 from central axis 48 downwardly towards bottom surface 37 both ways from central axis 48 thus establishing tapered plow edges 58, 59 on end joined sides 46, 45 respectively. Tapered plow edges 58, 59 may be further angled toward bottom surface 37 to establish sharply defined cutting edges 22, 21 respectively or, when extending fully to bottom surface 37, tapered plow edges 58, 59 effectively establish sharply defined cutting edges 21, 22. The operation of cutting tool element 56 is essentially identical to that of cutting tool element 14, however, sharply defined cutting edges 21, 22 provide for sharpened surfaces to more efficiently clean a surface of an aircraft skin while removing sealant from a groove between an aircraft skin and an edge of an inspection panel.

A method of making sealant removal tool 10 for removing sealant from grooves adjacent aircraft inspection panels comprises a step of making tool handle 11 by forming hand grip 16, disposing a rigid elongated shank 17 protruding from one end 18 of hand grip 16, providing means 19 for connecting on free end 20 of elongated shank 17 wherein free end 20 is threaded with a thread matching the thread of cooperating means 34 in cutting tool elements 12-14, 56, free end 20 also provided with a flange 42 at an end 43 of threaded portion 41. The final step of the method of making sealant removal tool 10 comprising the step of connecting one of cutting tool elements 12-14, 56 to free end 20 of elongated shank 17 by threading cutting tool element 12-14, 56 upon threaded portion 41 of elongated shank 17 abutting back wall 35 of proximal end 33 against flange 42.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A tool for removal of sealant from grooves adjacent aircraft inspection panels comprises a handle and a plurality of removable polymeric cutting tool elements wherein said handle further comprises a hand grip and an elongated shank protruding from one end of said hand grip, said elongated shank provided with a means for connecting on a free end thereof, said cutting tool element provided with a cooperating means for connecting disposed into a proximal end of said cutting tool element, said removable polymeric cutting tool elements provided with at least one sharply defined cutting edge and a plurality of sharply defined cutting points, one said sharply defined cutting edge of said cutting tool element disposed at a bottom edge of a sloped chisel surface on a distal end of said tool element, said bottom edge terminating in two said sharply defined cutting points, said proximal end of said cutting tool element provided with one said sharply defined cutting point disposed at at least one corner of a back wall thereof, said plurality of polymeric cutting tool elements thus providing varied tool point designs to permit greater and more efficient removal of said sealant from grooves between aircraft panels and adjacent aircraft skin without marring said aircraft skin.

2. A tool as in claim 1 wherein said means for connecting on said free end of said shank and said cooperating means for connecting disposed into said proximal end of said cutting tool element are selected from the group consisting of threads, quick disconnects, quarter-turn key lock, button lock, spring pin or combinations thereof.

3. A tool as in claim 2 wherein said sloped chisel surface is defined between a bottom surface and a top surface of said cutting tool element.

4. A tool as in claim 3 wherein said sloped chisel surface is disposed at an angle between 25 and 65 degrees relative to said bottom surface.

5. A tool as in claim 4 wherein said angle is 45 degrees.

6. A tool as in claim 5 wherein said sharply defined cutting points are bound by said bottom surface and sidewalls of said cutting tool element.

7. A tool as in claim 6 wherein said sharply defined cutting edge of said sloped chisel surface has a width between one half inch and one inch.

8. A tool as in claim 7 wherein said proximal end of said cutting tool element has said sharply defined cutting points disposed at all corners of said back wall of said proximal end.

9. A tool as in claim 5 wherein said sharply defined cutting points are bound by said bottom surface and side edges of said sloped chisel surface, said sloped chisel surface having at least one said side edge thereof disposed inwardly of one said sidewall of said cutting tool element.

10. A tool as in claim 9 wherein said sharply defined cutting edge of said sloped chisel surface has a width between one-sixteenth of an inch and one half inch.

11. A tool for removal of sealant from grooves adjacent aircraft inspection panels comprises a handle and a plurality of removable polymeric cutting tool elements wherein said handle further comprises a hand grip and an elongated shank protruding from one end of said hand grip, said elongated shank provided with a means for connecting on a free end thereof, said cutting tool element provided with a cooperating means for connecting disposed into a proximal end of said cutting tool element, said removable cutting tool elements are an arrowhead shape and provided with two sharply defined cutting edges and a plurality of sharply defined cutting points wherein said sharply defined cutting edges are disposed on opposed, end joined sides of said arrowhead shape and equally arranged relative to a central axis of said cutting tool element, said sharply defined cutting edges extending from one said sharply defined cutting point disposed at a terminal point of a distal end of said arrowhead shape, said sharply defined cutting edges terminating in sharply defined back end arrowhead points, said sharply defined cutting edge having an angle between 20 and 60 degrees relative to a central axis of said tool, said sharply defined cutting points severing said sealant from aircraft panel grooves without marring adjacent surfaces of an aircraft skin for efficient removal of said sealant.

12. A tool as in claim 11 wherein said angle is 30 degrees.

13. A tool as in claim 11 wherein said angle is 35 degrees.

* * * * *